US008042798B2

(12) United States Patent
Suzuki

(10) Patent No.: US 8,042,798 B2
(45) Date of Patent: Oct. 25, 2011

(54) SHEET SUPPLY APPARATUS, SHEET SUPPLY UNIT AND IMAGE FORMING APPARATUS WITH BLASTING SEPARATION AIR OUTLET

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/623,646

(22) Filed: Nov. 23, 2009

(65) Prior Publication Data

US 2010/0129127 A1 May 27, 2010

(30) Foreign Application Priority Data

Nov. 27, 2008 (JP) ..... 2008-302950

(51) Int. Cl.
*B65H 3/14* (2006.01)

(52) U.S. Cl. ..... 271/98; 271/30.1

(58) Field of Classification Search ..... 271/98, 271/30.1, 153

See application file for complete search history.

(56) References Cited

U.S. PATENT DOCUMENTS

| | | | | |
|---|---|---|---|---|
| 5,088,717 | A * | 2/1992 | Hamanaka et al. | 271/98 |
| 7,708,264 | B2 * | 5/2010 | Kosugi et al. | 271/98 |
| 7,850,162 | B2 * | 12/2010 | Imai et al. | 271/98 |
| 2006/0012107 | A1 * | 1/2006 | Ueda et al. | 271/98 |
| 2008/0088077 | A1 * | 4/2008 | Fujita | 271/90 |
| 2008/0237968 | A1 * | 10/2008 | Suzuki | 271/98 |
| 2009/0121411 | A1 * | 5/2009 | Kosugi et al. | 271/97 |
| 2010/0209163 | A1 * | 8/2010 | Suzuki | 271/3.17 |
| 2010/0295238 | A1 * | 11/2010 | Suzuki | 271/11 |

FOREIGN PATENT DOCUMENTS

JP 61-254438 A 11/1986

* cited by examiner

*Primary Examiner* — Gerald McClain
(74) *Attorney, Agent, or Firm* — Cantor Colburn LLP

(57) ABSTRACT

A sheet supply apparatus is provided which controls vertical movement of a sheet support tray so that a position of an upper surface of stacked sheets on the support tray is adjusted to a height located below a separation air outlet, wherein adsorption is possible at the height and so that a fall region, in which a pressure difference with respect to a separation region is generated, is formed below the separation region in which the separation air blasted from the separation air outlet is blasted along the sheet adsorbed on the adsorbent surface.

8 Claims, 7 Drawing Sheets

SHEET SUPPLY APPARATUS, SHEET SUPPLY UNIT AND IMAGE FORMING APPARATUS WITH BLASTING SEPARATION AIR OUTLET

RELATED APPLICATION

This application is based on Japanese Patent Application No. 2008-302950 filed with Japanese Patent Office on Nov. 27, 2008, the entire content of which is hereby incorporated by reference.

BACKGROUND

1. Technical Field

The present invention relates to a sheet supply apparatus wherein sheets placed on a sheet plate are adsorbed onto an adsorbent surface by air and are fed out, particularly to a sheet supply apparatus wherein a space not exposed to separation air is formed on the lower side of the region to which the separation air is blasted to the sheets adsorbed onto the adsorbent surface, between the sheets placed on the sheet plate and adsorbent surface.

2. Description of the Prior Art

A pneumatic sheet supply apparatus has been used as a sheet supply apparatus for an image forming apparatus in a photocopier and other devices. In the pneumatic sheet supply apparatus, air is blasted on the lateral end faces of the stacked sheets so that a sheet is raised, and the raised sheet is adsorbed onto the adsorbent surface of a punched belt or the like equipped with an air inlet for drawing in air. Then the belt is driven and rotated so that the sheet is conveyed.

In such a pneumatic sheet supply apparatus, when two or more sheets that are stuck to each other have been adsorbed onto the adsorbent surface, it is necessary to use a separation mechanism for separating these sheets.

In a well known separation mechanisms for an air supply mechanism, air is blasted on the end of the adsorbed sheets, and the sheets are separated by the air inserted therebetween. However, separation is difficult in the case of thin plain paper and recycled paper. Blasting of air alone often fails to separate sheets, and the problem of multiple sheet feed has been raised in this conventional mechanism.

To assist the separation effect by air blasting, one of the techniques known in the conventional art uses protrusions from the adsorbent surface (Japanese Patent Application Publication No. Sho 61-254438). In this method, one topmost sheet to which the suction force is directly applied is adsorbed onto the adsorbent surface so as to wrap around the protrusions. On the other hand, the suction force is not directly applied to the sheets having been adsorbed by being entrained by the topmost sheet. Thus, these sheets are stopped at the position where they have come in contact with the protrusions, or are adsorbed on the adsorbent surface with gradual deflection. In this manner, more accurate separation can be achieved by using the differences in postures between the topmost sheet, and second and later sheets.

SUMMARY

In the method wherein the sheet having been adsorbed onto the adsorbent surface are raised by the protrusions and separated, when sheets are conveyed, the protrusions and sheets are kept in contact with each other and are rubbed against each other. This may cause the sheet surface to be damaged by the protrusions for assisting the separation, when sheets are conveyed.

Further, the separation air blasted from a nozzle is also applied to the sheets having been separated. This will produce the force for raising the separated sheet, with the result that accurate separation cannot be performed.

In view of the prior art problems described above, it is an object of the present invention to provide a sheet supply apparatus capable of positively separating sheets by separation air, a sheet supply unit equipped with the sheet supply apparatus, and an image forming apparatus.

According to one aspect of the invention, there is provided a sheet supply apparatus including: a sheet support tray on which a plurality of sheets are stacked and capable of moving in a vertical direction; an upper limit detecting sensor for detecting a top surface position of the plurality of sheets stacked on the sheet support tray; an adsorbent surface for attracting the sheets stacked on the sheet support tray from a top surface of the stacked sheets and adsorbing the topmost sheet of the stacked sheets; a conveyance mechanism for conveying the sheet adsorbed on the adsorbent surface to a sheet conveyance path; a separation air blasting mechanism having a separation air outlet wherein separation air is blasted from a sheet conveyance path side of the adsorbed sheet, and blasting the separation air to a leading edge of the sheet adsorbed on the adsorbent surface; and a control section for controlling the movement in a vertical direction of the sheet support tray according to an output of the upper limit detecting sensor so that a position of an upper surface of the stacked sheets on the support tray is adjusted to a height located below the separation air outlet, wherein adsorption is possible at the height; and so that a fall region, in which a pressure difference with respect to a separation region is generated, is formed below the separation region in which the separation air blasted from the separation air outlet is blasted along the sheet adsorbed on the adsorbent surface, at least during a time from adsorption of sheets onto the adsorbent surface to a start of conveyance of the sheets by the conveyance mechanism when supplying a sheet.

In this sheet supply apparatus, if two or more sheets have been adsorbed on the adsorbent surface, suction force to the adsorbent surface will be applied to one topmost sheet when separation air is blasted, whereby the topmost sheet remains unmoved. Further, separation air applies the force of pressing against the adsorbent surface. In the meantime, the second and later sheets adsorbed by being entrained by the topmost sheet are separated by separation air. The fall region has an air pressure lower than that of the separation region because, separation air volume is reduced or separation air is not virtually blasted.

The fall region has an atmospheric pressure lower than that of the separation region. Thus, the force of pressing against the adsorbent surface by separation air is not virtually applied to the second and later sheets having been separated. The second and later sheets adsorbed by being entrained by the topmost sheet are removed by separation air, and are loaded again on the sheet support tray.

Preferably, the separation air blasted from the separation air outlet is blasted on the sheets having been adsorbed onto the adsorbent surface, approximately in the horizontal direction from the front of these sheets.

As described above, the separation air blasted is blasted on the sheets having been adsorbed onto the adsorbent surface, approximately in the horizontal direction. Thus, when one or more sheets have been adsorbed onto the adsorbent surface, the first sheet stays on the adsorbent surface and the second and later sheets can be positively separated.

Yet further preferably, there is provided a sheet raising air blast mechanism that blasts sheet raising air from a side of the sheets stacked on the sheet support tray, wherein the control section suspends the blasting of sheet raising air by the sheet raising air blast mechanism during a time from the adsorption of sheet on the adsorbent surface to the start of conveying the sheet adsorbed onto the adsorbent surface, and allows the separation air to be blasted by the separation air blasting mechanism.

Thus, while sheets are adsorbed, sheet raising air is blasted. This arrangement ensures positive suction of sheets onto the adsorbent surface. In the meantime, the blasting of sheet raising air is suspended during sheet separation. This ensures positive separation of sheets by separation air.

Yet further preferably, following condition is satisfied:

$$1/10 \leqq H1/H2 \leqq 2/5$$

where H1 is a adsorbent height that represents a distance between the adsorbent surface and the top surface of the stacked sheets on the sheet support tray and H2 is a separation air blasting height that represents a height of the separation air outlet.

As described above, the separation air blasting height is reduced with respect to the height where suction is possible. This arrangement allows the fall region to be increased along the height with respect to the separation region, whereby positive separation is ensured and, multiple feed can be avoided.

Yet further preferably, the separation air outlet has a horizontal length parallel to the adsorbent surface for ensuring that, when two or more sheets have been adsorbed onto the adsorbent surface, separation air for separating the second and later sheets can be blasted over a necessary and sufficient range for separation across the width of the sheet.

This arrangement ensures separation air to be blasted over the sufficient range required for separation across the width of the sheet, whereby positive separation can be achieved.

Yet further preferably, an adsorbent height that represents a distance between the adsorbent surface and the top surface of the stacked sheets on the sheet support tray where adsorption is possible does not exceed 25 mm, and the horizontal length of the separation air outlet is equal to or greater than 60 mm.

This permits the fall region to be enlarged along the height with respect to the separation region, without involving the non-feed range wherein the sheets cannot be adsorbed onto the absorbent surface. Further, separation air can be blasted over the sufficient range required for separation across the width of the sheet, whereby positive separation is ensured.

Yet further preferably, the separation air outlet is structured in such a way that, a separation air blasting height that represents a height of the separation air outlet is small at a position close to the center in a horizontal direction opposed to an area close to a center across the width of the sheet adsorbed onto the adsorbent surface, and the separation air blasting height is increased, as one goes toward both ends in the horizontal direction.

Thus, close to the center across the width of the sheet adsorbed onto the adsorbent surface, the volume of separation air blasted on the sheet is increased, and a sufficient volume of air required for separation can be obtained. This structure ensures positive separation.

According to another aspect of the invention, there is provided a sheet supply unit including:

a single or a plurality of sheet trays for accommodating sheets;

a sheet support tray loaded with a plurality of sheets by the sheet tray and capable of moving in the vertical direction along the direction wherein sheets are stacked;

an upper limit detecting sensor for detecting the top surface position of the sheets stacked on the sheet support tray;

an adsorbent surface for attracting the sheets stacked on the sheet plate from the top surface and adsorbing the topmost sheet;

a conveyance mechanism conveying the sheets adsorbed on the adsorbent surface to a sheet conveyance path;

a separation air blasting mechanism having a separation air outlet wherein separation air is blasted from the side of the sheet conveyance path, and blasting the separation air on the leading edge of the sheet adsorbed on the adsorbent surface; and a control section wherein, in the sheet supplying operation mode, at least during the time from suction of sheets onto the adsorbent surface to the start of conveyance of the sheets by the conveyance mechanism, the sheet support tray is moved in the vertical direction according to the output of the upper limit detecting sensor so that the top surface positions of the sheets attached on the sheet support tray are adjusted to the height located below the separation air outlet wherein suction is possible; and a fall region that produces a pressure difference with respect to the separation region is formed below the separation region wherein the separation air blasted from the separation air outlet is blasted along the sheets adsorbed on the adsorbent surface.

According to yet another aspect of the invention, there is provided an image forming apparatus including:

an image forming section for forming an image on a sheet;

a sheet supply apparatus for supplying a sheet to the image forming section; and a control section for providing control in such a way that sheets are supplied from the sheet supply apparatus to the image forming section and an image is formed by the image forming section;

wherein the sheet supply apparatus includes:

a sheet support tray loaded with a plurality of sheets and moving in the vertical direction along the direction wherein sheets are stacked;

an upper limit detecting sensor for detecting the top surface position of the sheets stacked on the sheet support tray;

an adsorbent surface for attracting the sheets stacked on the sheet plate from the top surface and adsorbing the topmost sheet;

a conveyance mechanism conveying the sheets adsorbed on the adsorbent surface to a sheet conveyance path; and a separation air blasting mechanism having a separation air outlet wherein separation air is blasted from the side of the sheet conveyance path, and blasting the separation air on the leading edge of the sheet adsorbed on the adsorbent surface; and the control section provides control in such a way that, in the sheet supplying operation mode, at least during the time from suction of sheets onto the adsorbent surface to the start of conveyance of the sheets by the conveyance mechanism, the sheet support tray is moved in the vertical direction according to the output of the upper limit detecting sensor so that the top surface positions of the sheets attached on the sheet support tray are adjusted to the height located below the separation air outlet wherein suction is possible; and a fall region that produces a pressure difference with respect to the separation region is formed below the separation region wherein the separation air blasted from the separation air outlet is blasted along the sheets adsorbed on the adsorbent surface.

According to the sheet supply apparatus of the present embodiment, separation air is blasted between the sheets stacked on the sheet support tray and the adsorbent surface, along the sheet adsorbed onto the adsorbent surface. Thus, a separation region is formed wherein the first sheet remains on the adsorbent surface and the second and later sheets are separated and, at the same time, a fall region is formed below the separation region, the fall region being a space of normal pressure with respect to the separation region in such a way that the separated sheets are removed into the sheet support tray. This arrangement improves the sheet separation performance, and ensures positive separation of thin sheets in particular.

According to the sheet supply unit of the present embodiment, there is provided the aforementioned sheet supply apparatus. This ensures the positive prevention of multiple sheet feed. Further, according to the image forming apparatus of the present invention, provision of the aforementioned sheet supply apparatus ensures positive prevention of multiple sheet feed and improves image quality.

DESCRIPTION OF THE PREFERRED EMBODIMENTS

Figure 1:
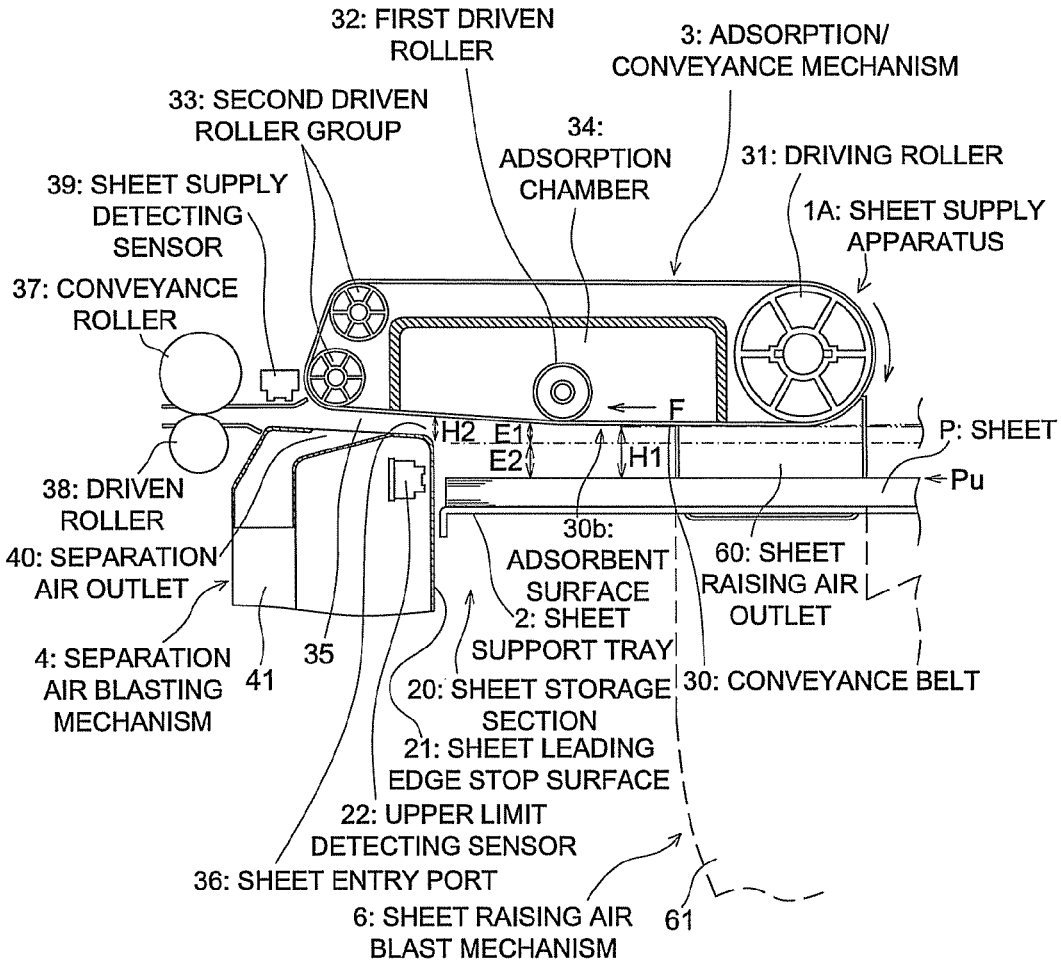
FIG. 1 is a side view of an example of the sheet supply apparatus as a first embodiment.

Referring to the drawings, the following describes the embodiments of a sheet supply apparatus of the present invention, a sheet supply unit equipped with a sheet supply apparatus, and an image forming apparatus connected with the sheet supply unit.

Configuration Example of the Sheet Supply Apparatus as a First Embodiment

Figure 2:
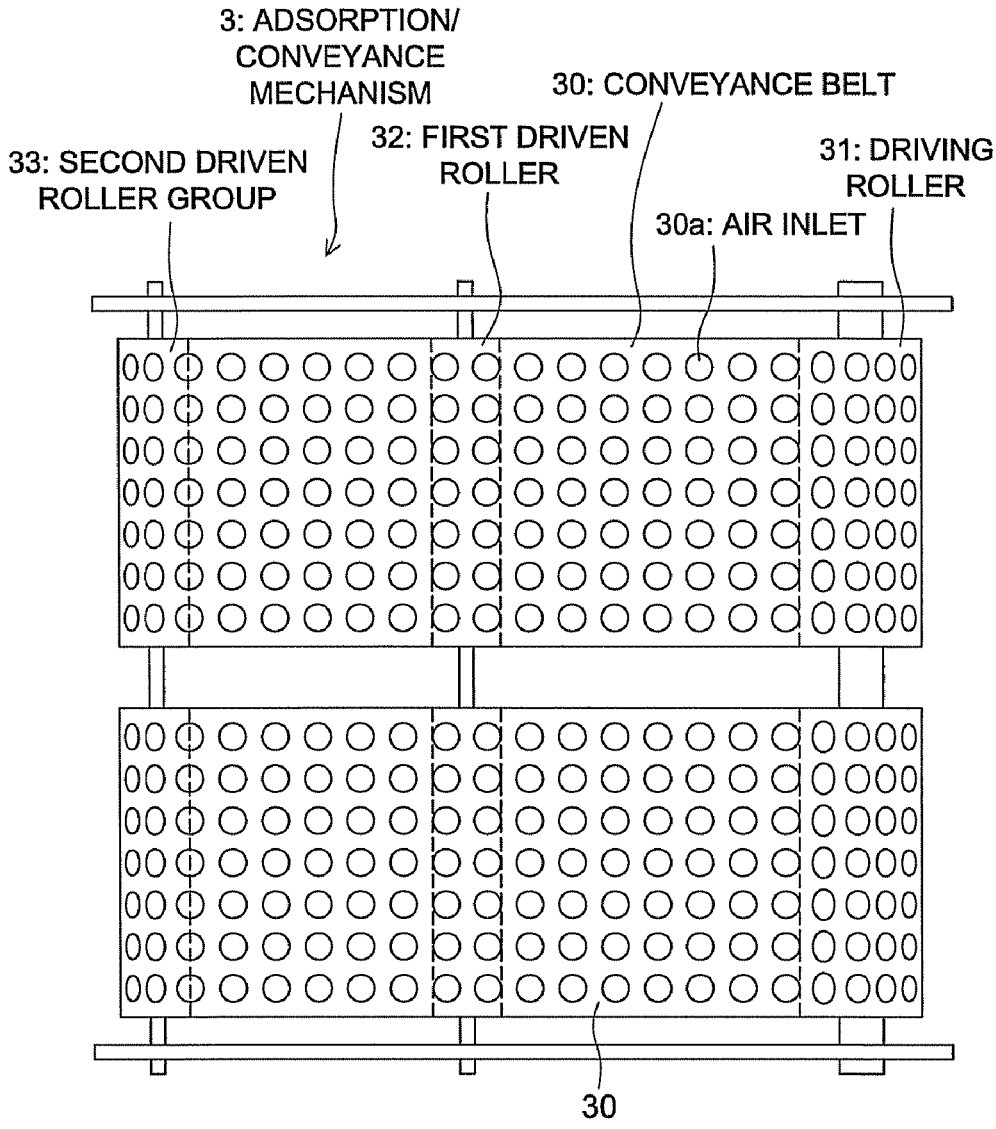
FIG. 2 is a plan view of an suction/conveyance mechanism as an example of the sheet supply apparatus in the first embodiment, as observed from below.
Figure 3:
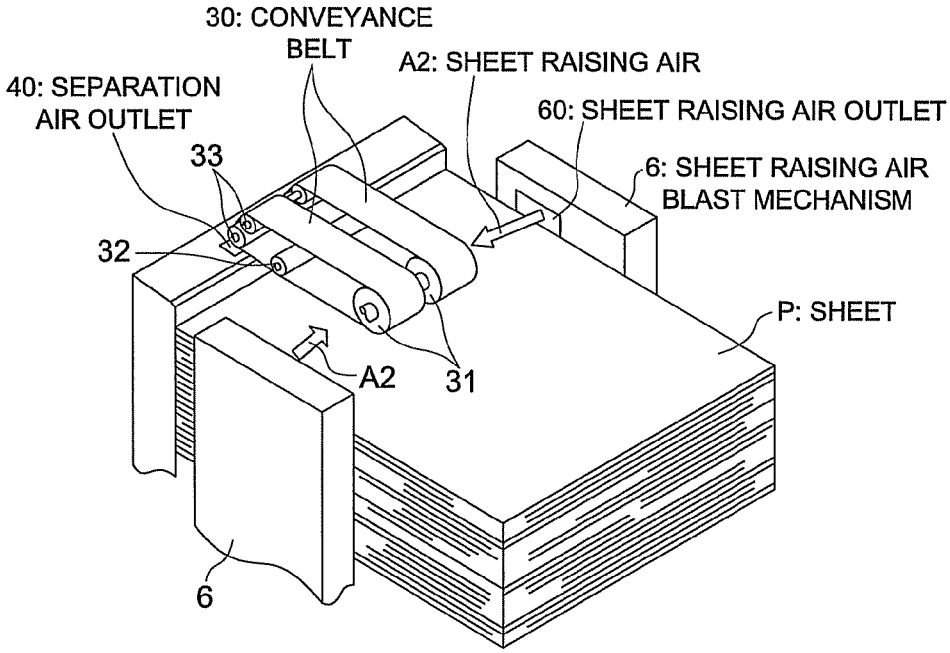
FIG. 3 is a perspective view of a sheet storage section as an example of the sheet supply apparatus in the first embodiment.

FIG. 1 is a side view of an example of the sheet supply apparatus as a first embodiment. FIG. 2 is a plan view of an suction/conveyance mechanism as an example of the sheet supply apparatus in the first embodiment, as observed from below. FIG. 3 is a perspective view of a sheet storage section as an example of the sheet supply apparatus in the first embodiment.

The sheet supply apparatus 1A as a first embodiment includes:

an suction/conveyance mechanism 3 for adsorbing the sheets P stacked on the sheet support tray 2 and feeding the same; and a separation air blasting mechanism 4 for blasting separation air A1 on the sheets P adsorbed by the suction/conveyance mechanism 3, from the front with respect to the direction of conveying the sheets P indicated by an arrow.

The separation air A1 blasted from the separation air blasting mechanism 4 is blasted on the sheet supply apparatus 1A along the sheet P adsorbed by the suction/conveyance mechanism 3. The sheet supply apparatus 1A is provided with a separation region E1 wherein separation air A1 is blasted between the sheets P adsorbed onto the suction/conveyance mechanism 3 and the sheets P stacked on the sheet support tray 2 along the sheet P adsorbed onto the suction/conveyance mechanism 3, and a fall region E2 wherein separation air A1 is not blasted. This arrangement produces a relative pressure difference between the separation region E1 and fall region E2, and ensures positive separation of the sheets P other than the one topmost sheet adsorbed onto the suction/conveyance mechanism 3, whereby multiple sheet feed is avoided.

The following describes the details of the sheet supply apparatus 1A as the first embodiment. The sheet supply apparatus 1A contains a sheet support tray 2 which is mounted on the sheet storage section 20 having a space capable of storing a predetermined number of the sheets P stacked thereon.

The sheet support tray 2 moves in the vertical direction in the direction of the stacked sheets P by an elevation mechanism (not illustrated). A sheet leading edge stop surface 21 for regulating the leading edge position of the sheets P stacked on the sheet support tray 21 is formed on the sheet storage section 20 along the direction of the sheet support tray 2 traveling in the vertical direction.

The sheet supply apparatus 1A includes an upper limit detecting sensor 22 for detecting the top surface position Pu of the sheets P stacked on the sheet support tray 2. The upper limit detecting sensor 22 is made of a pair of optical sensors, for example, and is positioned wherein the upper limit detecting sensor 22 can check that the top surface position Pu of the sheets P stacked on the sheet support tray 2 is located at height H1 wherein sheets P can be adsorbed onto the suction/conveyance mechanism 3.

When the sheets P stacked on the sheet support tray 2 are fed out by the suction/conveyance mechanism 3, the height of the sheets P stacked on the sheet support tray 2 will be reduced. Then, the sheet supply apparatus 1A allows the sheet support tray 2 to be raised to the position wherein the top surface position Pu of the sheets P can be detected by the upper limit detecting sensor 22, and provides control in such a way that the top surface position Pu of the sheets P stacked on the sheet support tray 2 is adjusted to the height H1 wherein sheets can be adsorbed by the suction/conveyance mechanism 3.

The suction/conveyance mechanism 3 is provided with a conveyance belt 30 located on the upper portion of the sheet storage section 20. Further, the suction/conveyance mechanism 3 includes a driving roller 31 wound with a conveyance belt 30, a first driven roller 32, and a second driven roller group 33 equipped with two driven rollers.

The conveyance belt 30 is an endless belt. Air inlets 30*a* penetrating the conveyance belt 30 are arranged in parallel across the width of the conveyance belt 30, and a plurality of air inlets 30*a* arranged across the width of the conveyance belt 30 are formed along the overall length of the conveyance belt 30.

The driving roller 31 includes a shaft perpendicular to the direction of the sheets P being conveyed, as indicated by arrow F, and is driven by a motor to be described later. The first driven roller 32 and the second driven roller group 33 have shafts parallel to that of the driving roller 31, and can be freely rotated in response to the rotation of the conveyance belt 30 caused by the rotation of the driving roller 31.

The second driven roller group 33 is located forward of the sheet leading edge stop surface 21 with respect to the direction wherein the sheets P are conveyed, as indicated by the arrow F. The driving roller 31 is located on the upper portion of the sheet support tray 2. Further, the first driven roller 32 is arranged on the upper portion of the sheet support tray 2 between the second driven roller group 33 and driving roller 31.

The conveyance belt 30 is applied between the driving roller 31 and the second driven roller group 33 in the direction wherein the sheets P are conveyed. Thus, the trailing edge side wound on the driving roller 31 of the conveyance belt 30 is positioned on the upper portion of the sheets P stacked on the sheet support tray 2, and the leading edge side wound on the second driven roller group 33 of the conveyance belt 30 is located forward of the sheet leading edge stop surface 21. Two conveyance belts 30 are arranged in parallel in the direction wherein the sheets P are conveyed.

When the driving roller 31 is driven in the direction of the arrow, each conveyance belt 30 is driven, and the side of the conveyance belt 30 facing the sheet support tray 2 moves in the direction of the arrow F wherein the sheets P are conveyed.

The bottom end position in the circumferential surface of the driving roller 31 is approximately flush with the bottom end position in the circumferential surface of the first driven roller 32. By contrast, of the second driven roller group 33, the bottom end in the circumferential surface of the driven roller on the on the bottom side is higher that the bottom end of the first driven roller 32 by a predetermined amount.

Thus, the side of the conveyance belt 30 facing the sheet support tray 2 between the driving roller 31 and the first driven roller 32 is approximately parallel to the surfaces of the sheets P stacked on the sheet support tray 2. By contrast, between the first driven roller 32 and the second driven roller group 33, there is an upward inclination in the direction wherein the sheets P are conveyed, and the conveyance belt 30 is bent at the position wherein the conveyance belt 30 is wound on the first driven roller 32.

The suction/conveyance mechanism 3 has an suction chamber 34 wherein the air for causing the sheet P to be adsorbed onto the conveyance belt 30 is sucked. In the suction chamber 34, the space wherein air is sucked by a fan (not illustrated) is formed inside the conveyance belt 30, and the lower side opposed to the conveyance belt 30 located at the side facing the sheet support tray 2 is closed. Air is sucked from the air inlet 30*a* of the conveyance belt 30 on the side facing the sheet support tray 2.

When the air of the suction chamber 34 has been sucked by the fan (not illustrated), the suction chamber 34 has a negative pressure. This causes air to be sucked through the air inlet 30*a* of the conveyance belt 30 located on the side facing the sheet support tray 2. Thus, a flow of air for adsorbing the sheets P is produced on the conveyance belt 30 on the side facing the sheet support tray 2.

This arrangement constitutes the adsorbent surface 30*b* that adsorbs the sheets P on the conveyance belt 30 on the side facing the sheet support tray 2 wherein air is sucked into the suction chamber 34 from the air inlet 30*a*.

The sheet supply apparatus 1A is equipped with the sheet conveyance path 35 wherein the sheets P fed out by the suction/conveyance mechanism 3 are conveyed. The sheet conveyance path 35 has a guide member that guides the conveyance of the sheets P adsorbed and fed out by the suction/conveyance mechanism 3. A sheet entry port 36 is formed to allow the sheets P to be inserted between the conveyance belt 30 on the side facing the sheet support tray 2 and the top end of the sheet leading edge stop surface 21.

The sheet supply apparatus 1A is provided with a conveyance roller 37 and driven roller 38 opposed to the conveyance roller 37 along the sheet conveyance path 35. The conveyance roller 37 is driven by the motor (to be described later) to convey the sheets P having been fed out by the suction/conveyance mechanism 3, the sheets P being sandwiched between the conveyance roller 37 and driven roller 38.

The sheet supply apparatus 1A has a sheet supply detecting sensor 39 on the sheet conveyance path 35. The sheet supply detecting sensor 39 is made of a pair of optical sensors, for example, and detects the sheets P fed out by the suction/conveyance mechanism 3.

The separation air blasting mechanism 4 has a separation air outlet 40 for blasting separation air A1 on the sheet entry port 36. The separation air outlet 40 has an air way to ensure that separation air A1 is blasted obliquely toward the sheet storage section 20 to hit the conveyance belt 30 positioned forwardly of the sheet leading edge stop surface 21.

The separation air blasting mechanism 4 ensures that the air sucked by the air blasting fan 41 is blasted through the separation air outlet 40. The separation air A1 blasted through the separation air outlet 40 hits the conveyance belt 30 obliquely. The air is blasted from the sheet entry port 36 along the adsorbent surface 30*b* made of the conveyance belt 30 on the side facing the sheet support tray 2. Thus, the separation air A1 blasted through the separation air outlet 40 passes through the sheet entry port 36 is blasted on the front of the sheets P adsorbed onto the adsorbent surface 30*b* by the suction/conveyance mechanism 3, wherein the air is approximately blasted from the horizontal direction of the sheets P.

The separation air outlet 40 through which separation air A1 is blasted is located above the position wherein the sheets P are detected by the upper limit detecting sensor 22. The height in the vertical direction wherein the separation air A1 is blasted is defined by the height H2 of the sheet entry port 36 formed in the space between the separation air outlet 40 and conveyance belt 30. The height H2 of the sheet entry port 36 will be referred to as the separation air blasting height. The height H1 of the sheets P stacked on the sheet support tray 2 and adsorbent surface 30*b* wherein suction is possible is set to a level wider than the separation air blasting height H2.

Thus, a separation region E1 is formed wherein the separation air A1 is blasted between the sheets P stacked on the sheet support tray 2 and the adsorbent surface 30*b* along the sheets P adsorbed onto the adsorbent surface 30*b*.

The separation region E1 is approximately formed in the range from the adsorbent surface 30*b* to the separation air blasting height H2 by the separation air A1 blasted from the sheet entry port 36.

In the meantime, a fall region E2 not exposed to separation air A1 is formed below the separation region E1. The fall region E2 is formed below the separation region E1 between the separation region E1 and the sheets P stacked on the sheet support tray 2 wherein the height from the adsorbent surface 30*b* is controlled so as to be equal to the height H1 wherein suction is possible, based on the output from the upper limit detecting sensor 22.

When the separation air A1 has been blasted from the separation air outlet 40, a relative pressure difference is produced between the separation region E1 wherein a sufficient volume of separation air A1 is blasted on the sheets P, and the fall region E2 is not exposed to blasting of the separation air A in real terms.

The sheet supply apparatus 1A is structured in such a way that the separation air A1 blasted from the separation air outlet 40 passes through the sheet entry port 36. Thus, the separation air blasting height H2 requires the height wherein one sheet P adsorbed and fed out by the suction/conveyance mechanism 3 can pass through completely. Assuming that the height H1 wherein suction is possible is 1, the separation air blasting height H2 is preferably 1/10 or more without exceeding 2/5.

In the separation air outlet 40, when two or more sheets P have been adsorbed onto the adsorbent surface 30*b* by the suction/conveyance mechanism 3, the separation air A1 for separating the second and later sheets P is blasted over a sufficient range required across the sheets P. Namely, the separation air outlet 40 has a predetermined horizontal length perpendicular to the direction wherein sheets P are conveyed, as indicated by the arrow F, and parallel to the adsorbent surface 30*b*.

Figure 4:
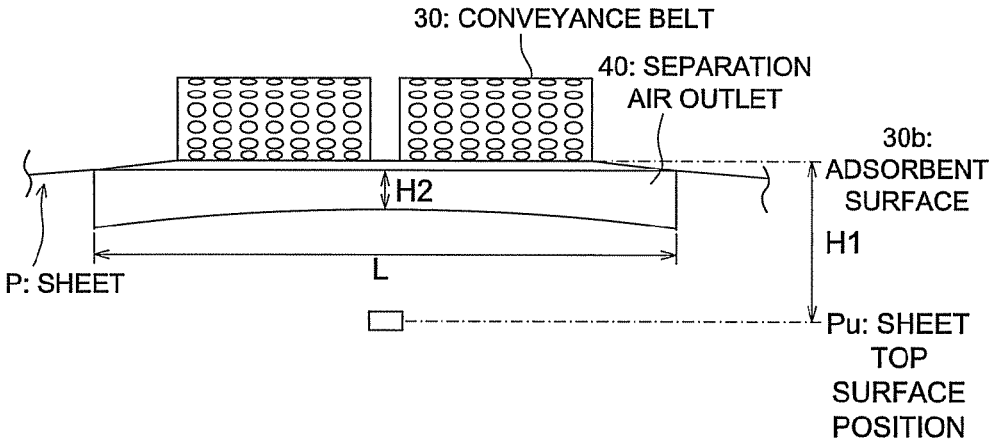
FIG. 4 is a diagram representing an example of the configuration of a separation air outlet.

FIG. 4 is a diagram representing an example of the configuration of a separation air outlet, and represents the separation air outlet 40 as viewed from the side of the sheet conveyance path 35. The horizontal length of the separation air outlet 40 indicted by the arrow L is preferably 60 mm or more.

In the separation air outlet 40, the separation air blasting height H2 is adjusted in the horizontal direction of the separation air outlet 40 indicted by the arrow L. The separation air outlet 40 is structured so that the separation air blasting height H2 is smaller close to the center in the horizontal direction opposed to the position close to the center across the width of the sheets P adsorbed onto the adsorbent surface 30*b* by the suction/conveyance mechanism 3, and the separation air blasting height H2 is increased as one goes toward both ends in the horizontal direction. In the separation air outlet 40, if the separation air blasting height H2 is smaller, the pressure of the blasted separation air A1 is greater. If the separation air blasting height H2 is greater, the pressure of the blasted separation air A1 is smaller.

Thus, the pressure of the separation air A1 blasted from the separation air outlet 40 is greater close to the center across the width of the sheets P adsorbed onto the adsorbent surface 30*b* by the suction/conveyance mechanism 3, and is gradually reduced as one goes toward both ends.

The sheet supply apparatus 1A has a sheet raising air blast mechanism 6 that blasts the sheet raising air A2 on the sheets P stacked on the sheet support tray 2 from the side. The sheet raising air blast mechanism 6 has a sheet raising air outlet 60 formed on the side of the sheet storage section 20. The sheet raising air blast mechanism 6 blasts the air sucked by the air blasting fan 61 from the sheet raising air outlet 60 as the sheet raising air A2. The sheet raising air A2 is blasted on the sheets P stacked on the sheet support tray 2 from the side so that sheets P are raised.

The sheet raising air blast mechanism 6 is provided with a shutter (not illustrated) that switches the ON/OFF status of the blasting operation from the sheet raising air A2. The sheet raising air outlet 60 is turned on or off by the drive solenoid (to be described later). When the sheet raising air outlet 60 has been turned on, the sheet raising air A2 is blasted. When the sheet raising air outlet 60 has been turned off, blasting of the sheet raising air A2 is suspended.

Figure 5:
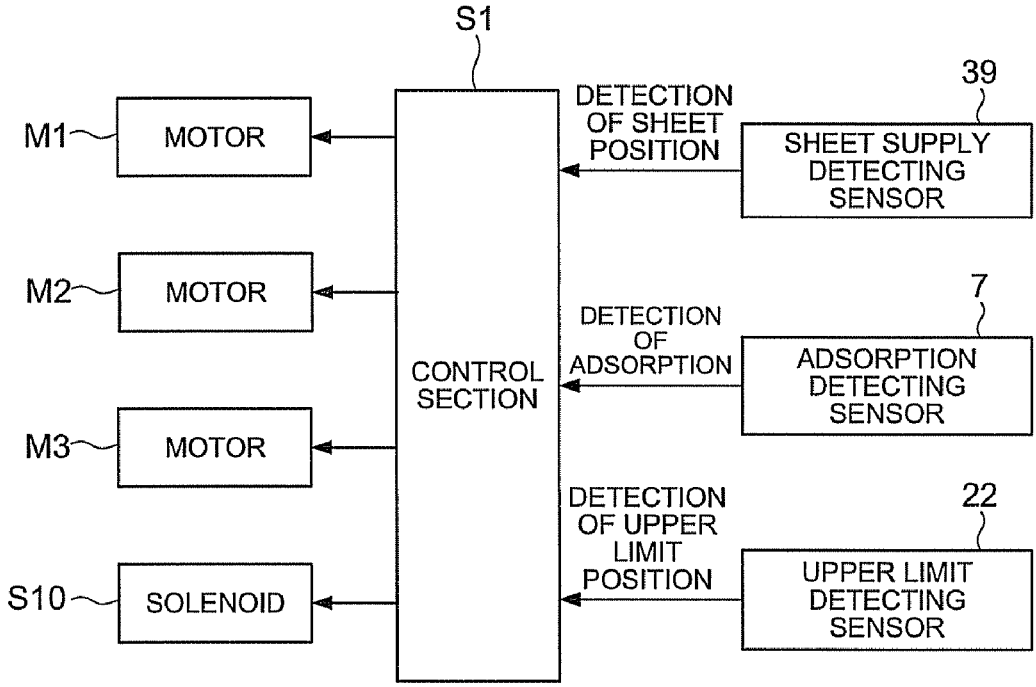
FIG. 5 is a functional block diagram showing an example of the control system of the sheet supply apparatus in the first embodiment.

FIG. 5 is a functional block diagram showing an example of the control system of the sheet supply apparatus in the first embodiment. The sheet supply apparatus 1A includes a control section S1 for sheet supply control. Checking the output from the suction detecting sensor 7, the control section S1 detects that sheets P have been adsorbed onto the adsorbent surface 30*b* by the suction/conveyance mechanism 3 shown in FIG. 1. Further, checking the output from the sheet supply detecting sensor 39, the control section S1 detects that the leading edges and trailing edges of the sheets P fed by the suction/conveyance mechanism 3 have reached a predetermined position.

The control section S1 controls the motor M1 that drives the driving roller 31 in conformity to the presence or absence of sheets P adsorbed onto the adsorbent surface 30*b* by the suction/conveyance mechanism 3 detected by the suction detecting sensor 7, and the position of the sheets P fed by the suction/conveyance mechanism 3 detected by the sheet supply detecting sensor 39. Further, the control section S1 controls the motor M2 for driving the conveyance roller 37 in conformity to the presence or absence of the sheets P and the conveyance position thereof detected by the suction detecting sensor 7 and sheet supply detecting sensor 39.

Further, in conformity to the presence or absence of the adsorbed sheets P and conveyance position detected by the suction detecting sensor 7 and sheet supply detecting sensor 39 the control section S1 controls the solenoid S10 for turning on or off the shutter (not illustrated) that switches between the presence or absence of the sheet raising air A2 blasted by the sheet raising air blast mechanism 6. The control section S1 controls the motor (not illustrated) that drives each air blasting fan. Further, the control section S1 controls the motor M3 for moving the sheet support tray 2 in the vertical direction in conformity to the presence or absence of the sheets P detected by the upper limit detecting sensor 22. In this case, the control section S1 can be made of the control section of the image forming apparatus, which will be described later.

Operation Example of the Sheet Supply Apparatus in the First Embodiment

FIG. 6 is a side view of the major portion representing an example of the operations of the sheet supply apparatus in the first embodiment. The following describes the operation example of the sheet supply apparatus 1A in the first embodiment with reference to each figure.

When sheet supply operation has started, based on the output of the upper limit detecting sensor 22, the control section S1 controls the motor M3 for moving the sheet support tray 2 in the vertical direction to ensure that the top surface position Pu of the sheets P stacked on the sheet support tray 2 reaches the height H1 wherein sheets can be adsorbed by the suction/conveyance mechanism 3.

In the operation of supplying the sheets P, the fan (not illustrated) of the suction/conveyance mechanism 3 is driven. At the same time, the air blasting fan 41 of the separation air blasting mechanism 4 and air blasting fan 61 of the sheet raising air blast mechanism 6 are driven, whereby the sheets P are adsorbed.

When the air of the suction chamber 34 has been sucked by the fan (not illustrated), the pressure of the suction chamber 34 turns negative. This allows the air to be sucked from the air inlet 30*a* of the conveyance belt 30 located on the side of the sheet support tray 2. Then a flow of air for adsorbing the sheets P is produced on the conveyance belt 30 on the side facing the sheet support tray 2. When the sheet raising air outlet 60 has been opened, the air sucked by the air blasting fan 61 is blasted from the sheet raising air outlet 60, the sheet raising air A2 is blasted from the side of the sheets P stacked on the sheet support tray 2.

Thus, in the sheets P stacked on the sheet support tray 2, the sheets P stacked on the top side are raised and the topmost sheet P stacked on the sheet support tray 2 is adsorbed onto the conveyance belt 30 constituting the adsorbent surface 30*b*. When the sheets P have been adsorbed onto the adsorbent surface 30*b*, both ends on the right and left are lowered, as compared to the position close to the center across the width of the sheets P adsorbed onto the adsorbent surface 30*b*, as shown in FIG. 4.

Checking the suction detecting sensor 7, the control section S1 detects that the sheets P have been adsorbed onto the conveyance belt 30. Immediately after this detection, the control section S1 drives the solenoid S10, and closes the sheet raising air outlet 60, thereby suspending blasting of the sheet raising air A2 from the sheet raising air outlet 60. The suction/conveyance mechanism 3 continues to adsorb the sheets P.

The conveyance belt 30 located on the side facing the sheet support tray 2 is bent at the position the conveyance belt 30 is round on the first driven roller 32. The conveyance belt 30 located between the first driven roller 32 and the second driven roller group 33 is inclined upward in the direction wherein the sheets P are conveyed. Thus, the sheet P adsorbed onto the conveyance belt 30 is a belt at the position wherein the conveyance belt 30 is wound on the first driven roller 32.

Figure 6A:
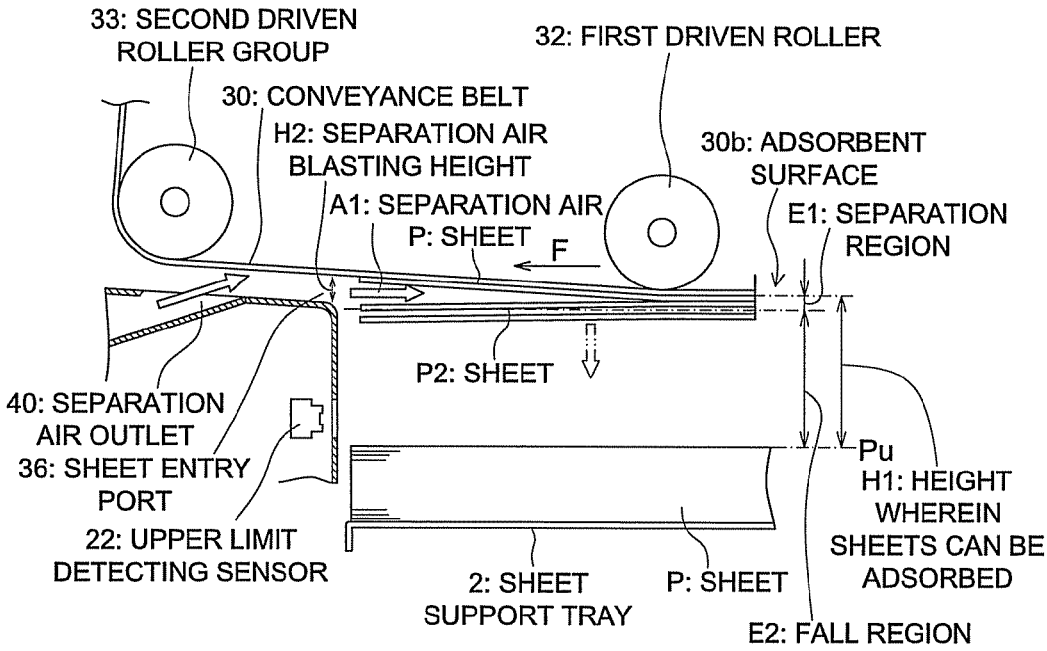
FIGS. 6*a* and 6*b* are side views of the major portion representing an example of operations of the sheet supply apparatus in the first embodiment.

When two or more sheets P have been adsorbed onto the conveyance belt 30 by the suction/conveyance mechanism 3, a plurality of sheets P are stuck to one another by static electricity. Thus, as shown in FIG. 6*a*, one topmost sheet P1 adsorbed to the conveyance belt 30 is directly subjected to the suction force, and therefore, the conveyance belt 30 is a belt conforming to the portion wound by the first driven roller 32.

By contrast, the second and later sheets P2 stuck to the topmost sheet P1 and adsorbed by the suction/conveyance mechanism 3 are not directly subjected to the suction force of the suction air. Thus, the second and later sheets P2 do not conform to the bent shape of the conveyance belt 30 at the portion wound by the first driven roller 32. One topmost sheet P1 and second and later sheets P2 are separated from one another by a gap produced from the leading edge surface.

In the separation air blasting mechanism 4, when the air blasting fan 41 is driven, air sucked by the air blasting fan 41 is blasted from the separation air outlet 40. The separation air A1 blasted from the separation air outlet 40 is shaped to conform to the conveyance belt 30 on the side facing the sheet support tray 2. The separation air A1 is blasted on the sheet P approximately in the horizontal direction from the front of the sheets P adsorbed onto the conveyance belt 30 on the side facing the sheet support tray 2 by the suction/conveyance mechanism 3.

In the sheet supply apparatus 1A, the vertical travel of the sheet support tray 2 is controlled in such a way that the top surface position Pu of the sheets P stacked on the sheet support tray 2 will reach a predetermined height H1 wherein suction is possible, with respect to the adsorbent surface 30*b* by the conveyance belt 30.

Thus, a separation region E1 wherein separation air A1 is blasted in conformity to the sheets P adsorbed onto the adsorbent surface 30*b* is formed between the sheets P stacked on the sheet support tray 2 and adsorbent surface 30*b*. In the meantime, the fall region E2 not exposed to the separation air A1 in real terms is formed below the separation region E1.

When the separation air A1 is blasted from the separation air outlet 40, a relative pressure difference is produced between the separation region E1 exposed to a sufficient amount of separation air A1 required for the separation of the sheets P and the fall region E2 not exposed to the separation air A1 in real terms.

When two or more sheets P have been adsorbed to the conveyance belt 30 by the suction/conveyance mechanism 3, a gap is produced on the leading edge surfaces of the one topmost sheet P1 and the second and later sheets P2, as described above. Then the separation air A1 blasted on the sheet P approximately in the horizontal direction from the separation air blasting mechanism 4 is blasted between the one topmost sheet P1 adsorbed onto the conveyance belt 30 and the second and later sheets P2.

In the separation region E1, when two or more sheets P have been adsorbed onto the conveyance belt 30 by the suction/conveyance mechanism 3, a sufficient volume of separation air A1 required for the separation of sheets P is blasted between the one topmost sheet P1 and the second and later sheets P2. Further, the separation air outlet 40 is structured in such a way that the separation air blasting height H2 is smaller close to the center opposed to the position close to the center across the width of the sheets P. Thus, the pressure of the separation air A1 blasted close to the center across the width is increased. Therefore, across the width of sheets P, a sufficient volume of separation air A1 required for separation is blasted close to the center adsorbed to the adsorbent surface 30*b* by the conveyance belt 30.

The one topmost sheet P adsorbed onto the conveyance belt 30 is subjected to the suction force of suction air on the conveyance belt 30 and pressure of separation air A1, and remains adsorbed onto the conveyance belt 30.

In the meantime, the second and later sheets P2 having been entrained by the topmost sheet P1 and adsorbed onto the conveyance belt 30 are separated by the separation air A1. The fall region E2 is not exposed to the separation air A1 in real terms, and therefore, the air pressure thereof is lower than that of the separation region E1.

Figure 6B:
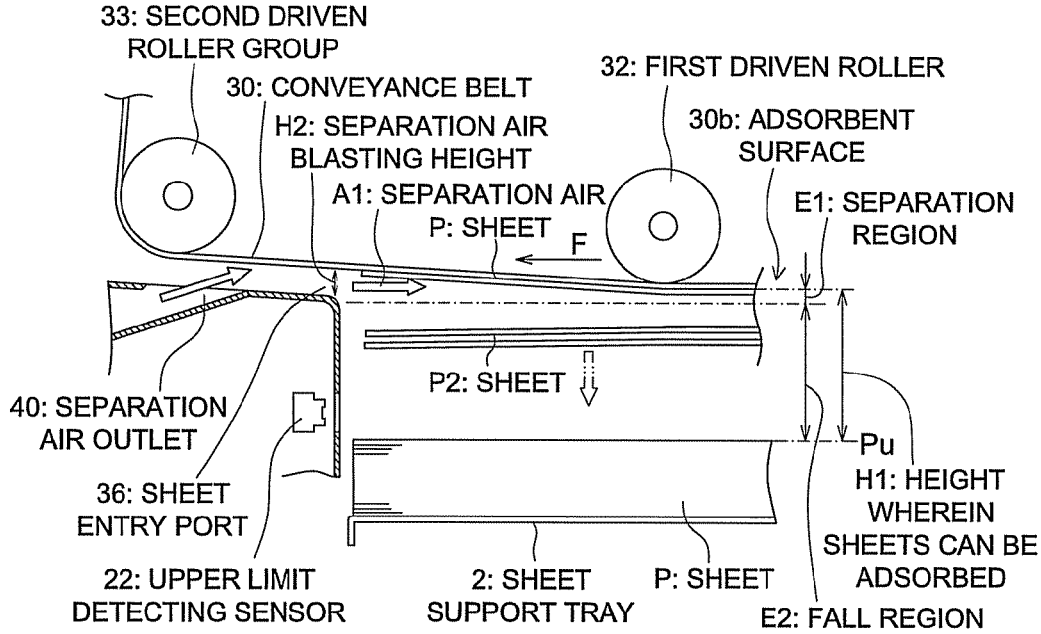

The fall region E2 has an air pressure lower than that of the separation region E1. The force of pressing onto the conveyance belt 30 by the separation air A1 is not applied in real terms to the second and later sheets P2 separated from the first sheet P1 adsorbed onto the conveyance belt 30. Further, the blasting of the sheet raising air A2 is suspended, and the force of raising the sheets P is not applied. Thus, the second and later sheets P2 entrained by the first sheet P1 and adsorbed onto the conveyance belt 30 are separated and removed by the separation air A1, as shown in FIG. 6*b*. These sheets are again stacked on the sheet support tray 2.

Between the conveyance belt 30 and sheets P stacked on the sheet support tray 2, the fall region E2 is required to have a greater space along the height than the separation region E1 in order to remove the sheets P separated by the separation air A1, from the first sheet P1 adsorbed onto the conveyance belt 30. If the fall region E2 has a sufficiently greater space along the height than the separation region E1, the sheets P having been separated are allowed to fall down quickly due to its own weight and relative pressure difference. This arrangement minimizes the occurrence of multiple sheet feed and maximizes the level of reliability.

To increase the height of the fall region E2 over that of the separation region E1, the H2/H1 should be minimized according to the relative relationship between the separation air blasting height H2 and the height H1 wherein suction is possible. However, if the height H1 wherein suction is possible is excessively increased, sheets P cannot be adsorbed onto the conveyance belt 30 by the suction force of the suction/conveyance mechanism 3 and raising force of the sheet raising air A2, with the result that the sheets P cannot be conveyed. In the meantime, if the separation air blasting height H2 is insufficient, the sheets P will enter the sheet entry port 36, and the required space cannot be ensured.

Accordingly, the relative relationship between the separation air blasting height H2 and height H1 wherein suction is possible is preferably set in such a way that the H2/H1 will be at least about 1/10. Further, if the H2/H1 is increased, the expected separation performance cannot be obtained. Thus, the H2/H1 is preferably set to at most about 2/5. To put it more specifically, if the height H1 wherein suction is possible is 16 (mm), and the separation air blasting height H2 is 2.5 to 4 (mm) or thereabout, it is possible to avoid a possible failure of conveying the sheets P and to enhance the separation performance.

The control section S1 provides control in such a way that, after the lapse of a predetermined separation standby time from the time when the sheets P have been adsorbed onto the conveyance belt 30 by the suction/conveyance mechanism 3, the driving roller 31 of the suction/conveyance mechanism 3 is driven by the motor M1, and the conveyance roller 37 is driven by the motor M2, whereby the operation of supplying the sheets P starts.

When the driving roller 31 is driven in the direction of the arrow, the conveyance belt 30 is driven, and the side of the conveyance belt 30 facing the sheet support tray 2 is moved in the direction of the arrow F. The sheets P adsorbed onto the conveyance belt 30 are fed out by the suction/conveyance mechanism 3 in the direction of conveyance, indicated by the arrow F.

When the sheets P adsorbed by the suction/conveyance mechanism 3 have been fed out by the conveyance belt 30, the leading edges of the sheets P fed out are detected by the sheet supply detecting sensor 39. At the same time, the sheets P fed out are sandwiched by the conveyance roller 37 and driven roller 38.

Having detected that the leading edge of the first sheet P fed out by the conveyance belt 30 has reached the conveyance roller 37, the control section 31 opens the sheet raising air outlet 60 so that the blasting of sheet raising air A2 is restarted from the sheet raising air outlet 60.

After detecting that the leading edges of the sheets P fed out by the conveyance belt 30 have reached the sheet supply detecting sensor 39, the control section S1 suspends the drive of the driving roller 31, after the elapse of a standby time predetermined with consideration given to the time before the sheets P are sandwiched by the conveyance roller 37 and driven roller 38. In the meantime, the conveyance roller 37 continues to be driven.

Thus, the first sheet P sandwiched by the conveyance roller 37 and driven roller 38 is conveyed. It should be noted that, in the operation of supplying the sheets P, the operation of adsorbing the sheets P by the suction/conveyance mechanism 3 continues, and the conveyance belt 30 is subjected to the force of adsorbing the sheets P. However, the force of conveyance by sandwiching between the conveyance roller 37 and driven roller 38 is greater than the suction force, and the sheets P are pulled out with the conveyance belt 30 kept suspended.

When the first sheet P sandwiched by the conveyance roller 37 and driven roller 38 has been conveyed, the second sheet P is adsorbed by the conveyance belt 30 in the continuous sheet supply mode. After that, the same control as that of the first sheet P is performed.

Configuration Example of the Sheet Supply Unit in the Present Embodiment

Figure 7:
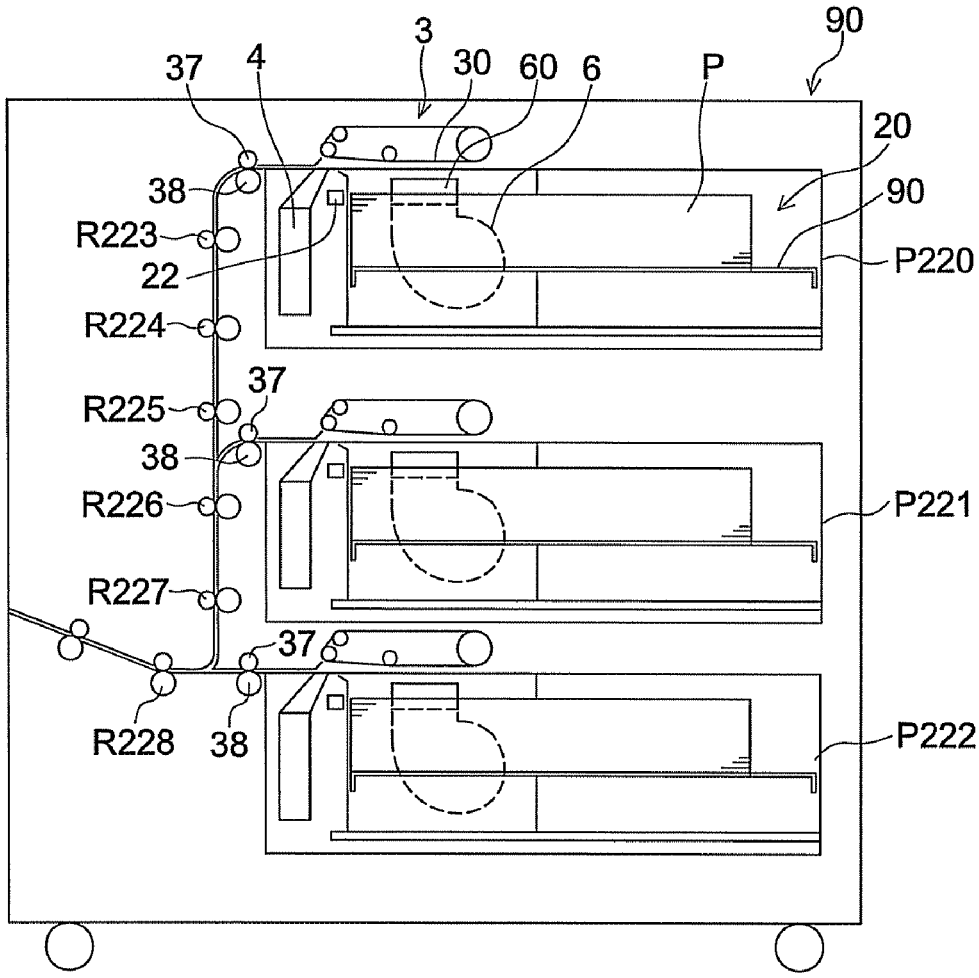
FIG. 7 is a configuration diagram showing an example of the sheet supply unit equipped with the sheet supply apparatus of each embodiment.

FIG. 7 is a configuration diagram showing an example of the sheet supply unit equipped with the sheet supply apparatus of each embodiment. The sheet supply unit 90 is provided with a plurality of sheet trays constituting the sheet storage section 20 of FIG. 1 and others, namely, three sheet trays P220, P221 and P222 in this example. Each of the sheet trays P220, P221 and P222 includes an upper limit detecting sensor 22 for detecting the top surface position of the sheets P stacked on the sheet support tray 2. An suction/conveyance mechanism 3 equipped with the conveyance belt 30 of FIG. 1 and others is mounted on each of the sheet trays P220, P221 and P222.

Further, there is provided a separation air blasting mechanism 4 for blasting the separation air A1 between the one topmost sheet and the second and later sheets, when two or more sheets P have been adsorbed by the suction/conveyance mechanism 3. Further, a sheet raising air outlet 60 is formed on the side of each of the sheet trays P220, P221 and P222, and there is provided a sheet raising air blast mechanism 6 that blasts sheet raising air from the side of the sheets P stacked on the sheet trays P220, P221 and P222.

The sheet trays P220, P221 and P222 are mounted so that these trays can be pulled out in the forward and backward direction of the drawing, by opening a front door (not illustrated) provided on the front of the drawing. It is also possible to arrange such a configuration that the front surfaces of the sheet trays are made of an exterior panel, which is equipped with a handle to be gripped by hand, so that the handle is used to pull out or push in the sheet trays.

The sheets P are supplied by the suction/conveyance mechanism 3 in the direction perpendicular to the direction of pulling out each of the sheet trays P220, P221 and P222 (leftward in the drawing).

The sheets P adsorbed by the suction/conveyance mechanism 3 can be separated into one sheet by the operation of the separation air blasting mechanism 4. The sheets P fed out from the sheet tray P220 by the suction/conveyance mechanism 3 are sandwiched by a pair of conveyance roller 37 and driven roller 38 having a nip portion approximately flush with the lower surface of the conveyance belt 30 wound on the driven roller on the lower side of the second driven roller group 33 shown in FIG. 1.

The sheets P sandwiched by the conveyance roller 37 and driven roller 38 are conveyed by the conveyance roller 37. At the same time, the direction of conveyance is converted downward by the operation of the guide member. This is followed by the step of the sheets P being conveyed downward by the conveyance rollers R223 through R227 constituting the sheet conveyance path in the vertical direction. After having been guided by the guide member approximately in the horizontal direction on the left of the drawing, the leading edge is brought in contact with the conveyance roller R228 whose rotation is suspended, whereby the sheets P are stopped.

The conveyance roller R228 serves as a registration roller that adjusts the time interval with respect to the image forming process in the image forming apparatus 10 (to be described later). After that, the sheets P are fed into the image forming apparatus by the start of rotation of the conveyance roller R228 and others.

Similarly, the sheets P fed out from the sheet tray P221 by the suction/conveyance mechanism 3 are sandwiched by a pair of conveyance roller 37 and driven roller 38 having a nip portion approximately flush with the lower surface of the conveyance belt 30 wound on the driven roller on the lower side of the second driven roller group 33 shown in FIG. 1.

The sheets P sandwiched by the conveyance roller 37 and driven roller 38 are conveyed by the conveyance roller 37, and the direction of conveyance is converted downward by the operation of the guide member. This is followed by the step of the sheets P being conveyed downward by the conveyance rollers R226 and R227. After having been guided by the guide member approximately in the horizontal direction on the left of the drawing, the leading edge is brought in contact with the conveyance roller R228 whose rotation is suspended, whereby the sheets P are stopped. After that, the sheets P are fed into the image forming apparatus by the start of rotation of the conveyance roller R228.

Further, the sheets P fed out of the sheet tray P222 by the suction/conveyance mechanism 3 are sandwiched by a pair of conveyance roller 37 and driven roller 38 having a nip portion approximately flush with the lower surface of the conveyance belt 30 wound on the driven roller on the lower side of the second driven roller group 33 shown in FIG. 1.

The sheets P sandwiched by the conveyance roller 37 and driven roller 38 are conveyed by the conveyance roller 37. The leading edges of the sheets P are brought in contact with the conveyance roller R228 whose rotation is suspended, whereby the sheets P are stopped. After that, the sheets P are fed into the image forming apparatus by the start of rotation of the conveyance roller R228.

Figure 8:
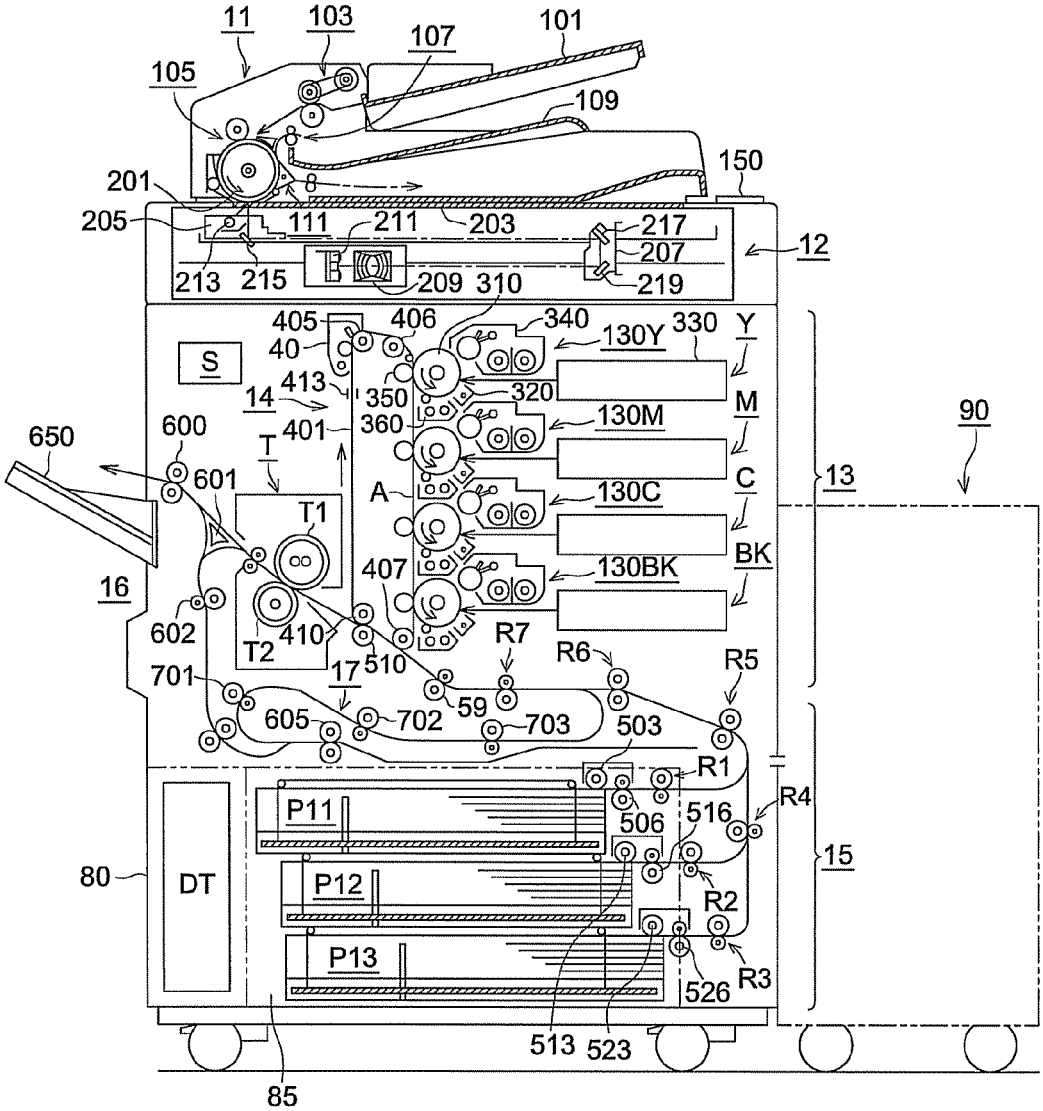
FIG. 8 is a configuration diagram showing an example of the image forming apparatus connected with the sheet supply unit equipped with the sheet supply apparatus of each embodiment.

Configuration Example of the Image Forming Apparatus in the Present Embodiment FIG. 8 is a configuration diagram showing an example of the image forming apparatus connected with the sheet supply unit equipped with the sheet supply apparatus of each embodiment. The image forming apparatus 10 is a digital color photocopier, for example, and the upper portion of the apparatus body is provided with an automatic document conveyance apparatus 11. Further, the image forming apparatus 10 incorporates an image reading section 12, image forming section 13, belt unit 14, sheet supply section 15, fixing apparatus T, reverse ejection section 16, and sheet re-supply section 17.

The automatic document conveyance apparatus 11 feeds out the documents one by one and conveys them to the image readout position. After the image has been read, the documents are ejected to the document ejection tray.

The automatic document conveyance apparatus 11 includes a document placement tray 101, document separation section 103, document conveyance section 105, document ejection section 107, document ejection tray 109, and document reversing roller 111 for reversing the documents.

A plurality of documents placed on the document placement tray 101 are separated from one other by the document separation section 103, and are conveyed to the image readout position through the document conveyance section 105.

The document readout position is located downstream of the document conveyance section 105, and the image of the document is read through the slit 201 of the image reading section 12. The document wherein the image has been read is ejected to the document ejection tray 109 by the document ejection section 107. When both sides are read, the document whose one side has been read is conveyed by the document reversing roller 111 in the direction indicated by the two-dot chain line arrow.

The document in the direction of being conveyed is stopped, with the trailing edge thereof being sandwiched. After that, the document is again conveyed to the image readout position through the document conveyance section 105 by the reverse rotation of the document reversing roller 111. After that, the document is ejected to the document ejection tray 109 by the document ejection section 107.

The aforementioned process is repeated for a plurality of documents placed on the document placement tray 101.

The image reading section 12 includes:

a first mirror unit 205 composed of an integration of the aforementioned slit 201, a document illumination lamp 213 and a first mirror 215 that reflects the reflected light of the document; and a second mirror unit 207 made up of an integration of a second mirror 217 and third mirror 219.

The image reading section 12 also includes:

an imaging lens 209 that allows the reflected light from a third mirror 219 to be formed on the image pickup element; and a linear image pickup element (hereinafter referred to as "CCD") 211 that performs photoelectric conversion of the optical image formed by the imaging lens 209, whereby image information is obtained.

In the example where the document conveyed by the automatic document conveyance apparatus 11 is read by the image reading section 12, the first mirror unit 205 and the second mirror unit 207 are fixed at the position indicated in the drawing.

The image information having been read by the image reading section 12 is subjected to appropriate image processing and is stored in the memory of the control section. The information of each color image read by the image reading section 12 and stored in the memory is sequentially read out from the memory, and is sent to the image forming section 13 for each color in the form of an electric signal.

The image forming section 13 includes four sets of image forming units 130 (130Y, 130M, 130C, and 130BK) for yellow (Y), magenta (M), cyan (C), and black (BK) that form toner images according to the color resolution image.

Each of the image forming units 130 consists mainly of a photoreceptor 310 having a photosensitive layer provided on the drum-like metallic substrate, a charging device 320, an exposure optical system 330 image writing means, a development apparatus 340, a primary transfer section 350, and a cleaning section 360. It should be noted that the exposure optical system 330 is an exposure unit made up of a laser optical system.

In the drawing, only the members constituting the yellow (Y) image forming unit are assigned with reference numerals. Other image forming units will not be assigned with reference numerals because the similar structure is employed.

The development apparatus 340 incorporates a two-component developer containing a carrier and toner. Further, the development apparatus 340 includes a cylindrical non-magnetic development sleeve incorporating a plurality of fixed magnets, a developer storage section and toner density detecting sensor.

The developer is magnetically carried on the development sleeve through the action of a plurality of magnets, and is conveyed to the development region by the rotation of the development sleeve. Then the developer subjected to development processing is removed from the development sleeve by the action of the repulsive magnetic field. Further, the bias voltage made up of the superimposition of the direct current and alternating current of a predetermined polarity (negatively charged in this case) is applied to the development sleeve.

The primary transfer section 350 is made of the primary transfer roller opposed to the peripheral surface of the photoreceptor 310 through the intermediate transfer belt 401.

The cleaning section 360 removes the remaining toner from the photoreceptor 310 after primary transfer. The removed toner is accommodated in a waste toner box DT installed on the side of the sheet tray.

The image forming units 130 of different colors are arranged in the order of yellow (Y), magenta (M), cyan (C), and black (BK) in the traveling direction on the plane surface A of the intermediate transfer belt 401 arranged in the vertical direction, as viewed from the top.

The belt unit 14 is made of the aforementioned intermediate transfer belt 401, support rollers 405, 406 and 407 to which this intermediate transfer belt is applied, and a backup roller 410 and others.

A secondary transfer section is made up of the transfer roller 510 and the backup roller 410 which is arranged opposed to the transfer roller 510 by sandwiching the intermediate transfer belt 401, and is driven in the form pressed against the transfer roller 510.

In the image forming apparatus 10, the image forming process is carried out as follows: The surface of the photoreceptor 310 rotating in the counterclockwise direction in the drawing is charged to a predetermined polarity (negatively charged in this case) by the charging device 320.

This is followed by the exposure step corresponding to the first color signal, namely, the yellow (Y) image by the exposure optical system 330. Thus, a latent image corresponding to this yellow (Y) image is formed on the photoreceptor 310.

The latent image on the photoreceptor 310 is reversely developed in the contact or non-contact mode by the developer of the development apparatus 340. After a yellow (Y) toner image has been formed on the photoreceptor 310, the image is primarily transferred onto the intermediate transfer belt 401 by the primary transfer section 350.

Similarly to the case of the yellow, the image forming processes of other color signals is to be started sequentially after a predetermined period of time from the start of forming an image by the first color signal is performed by the image forming units 130 of magenta (M), cyan (C) and black (BK).

The toner images of different colors formed on the photoreceptor 310 are superimposed on the intermediate transfer belt 401, and are secondarily transferred, and color toner images are formed on the intermediate transfer belt. In the meantime, after completion of the primary transfer processing, the surface of the photoreceptor 310 is cleaned by the cleaning section 360.

The starting time of each image forming process for the photoreceptor 310 or intermediate transfer belt 401 is determined as follows: Outside the intermediate transfer belt 401, a registration sensor 413 is provided in the area from the transfer roller 510 to the yellow image forming unit, as viewed from the rotating direction of the intermediate transfer belt.

Time counting starts from the point of time when the reference mark put on the intermediate transfer belt 401 has been detected by the registration sensor 413. Thus, after the lapse of a predetermined time period the (Y), (M), (C) and (BK) image forming processes are started sequentially.

The control section S includes a CPU for computation control processing, a ROM for storing various forms of program and a RAM for storing various forms of data, and provides all sorts of controls including control of a series of image forming processes.

The image forming apparatus 10 includes three sheet trays P11, P12 and P13 provided on the lower portion of the apparatus body. Each of the sheet trays P11, P12 and P13 can be provided with an suction/conveyance mechanism 3 equipped with the aforementioned conveyance belt, a separation air blasting mechanism 4, a sheet raising air blast mechanism 6 and others. Each of the sheet trays P11, P12 and P13 can be pulled out toward the front in the drawing.

The sheet trays P11, P12 and P13 are equipped with sheet supply rollers 503, 513 and 523, separation rollers 506, 516 and 526, and conveyance rollers R1, R2 and R3. The sheets P fed out by these rollers are conveyed by the conveyance rollers R4 through R7.

The registration roller 59 is located downstream of the conveyance roller R7 and close to the secondary transfer section. A fixing apparatus T is arranged downstream of the secondary transfer section on the conveyance path, wherein this fixing apparatus T includes the fixing roller T1 incorporating a heat source, and a pressure roller T2 which is driven in the form pressed against the fixing roller T1.

The ejection roller 600 ejects the sheets P wherein images are formed. The ejection tray 650 accommodates the sheets P ejected by the ejection roller 600.

The reversing/ejection section 16 reverses, conveys and ejects the ejected sheets P. The sheet re-supply section 17 reverses and conveys the sheets with an image formed on one side, and re-supplies the sheets to the registration roller 59.

The following describes the apparatus and structure thereof, in connection with the processes wherein the color toner image formed on the intermediate transfer belt 401 is transferred onto the sheets P and the sheets are ejected out of the apparatus.

At appropriate time intervals corresponding to the images on the intermediate transfer belt 401, the sheets P are supplied by the sheet supply roller 503 (513, 523). The sheets P to be supplied have the dimensions selected on the operation/display section 150 wherein the number of sheets, start button, magnification and image density can be set. The sheets P are supplied from the sheet trays P11, P12 and P13 of the apparatus, or the sheet trays P220, P221 and P222 of the sheet supply unit 90.

This is followed by the step of the sheets P being sandwiched and conveyed by the separation roller 506 and a plurality of conveyance rollers R1 through R7 provided on the conveyance path. The sheets P are then conveyed to the registration roller 59 arranged upstream of the secondary transfer section.

After the leading edges of the sheets P have been brought in contact with the registration roller 59, the sheets P are supplied by re-rotation of the registration roller 59 at the time interval overlapping the color toner image area on the intermediate transfer belt 401.

In the secondary transfer section, the sheets P together with the intermediate transfer belt 401 are then pressed and sandwiched by the backup roller 410 and transfer roller 510. During this time, the color toner image intermediate transfer belt 401 is secondarily transferred onto the sheets P. In the secondary transfer, a predetermined transfer bias voltage is preferably applied to the transfer roller 510.

The sheets P with the color toner image transferred thereon are separated from the intermediate transfer belt 401, and are conveyed to the fixing apparatus T by the conveyance belt (not illustrated). Then the color toner is fused by heating and pressing operations and is fixed on the sheets P.

The sheets P subsequent to the fixing operation by the fixing apparatus T are conveyed to the ejection roller 600 located downstream, and are ejected to the ejection tray 650 outside the apparatus body. In the meantime, the surface of the intermediate transfer belt 401 subsequent to secondary transfer is cleaned by the cleaning section 360. This is followed by the step of transferring the next color toner image.

In the drawing, switching member 601 is positioned wherein the sheets P are ejected subsequent to the fixing operation, without being reversed. When the sheets P are to be reversed and ejected, the switching member 601 is rotated a predetermined amount, and the sheets P subsequent to the fixing operation are guided downward along the right side of the switching member 601.

After the sheets P have been stopped by the reversing roller 602 with the trailing edge sandwiched, the sheets P are raised along the left side of the switching member 601 by the reverse rotation of the reversing roller 602, and are ejected through the ejection roller 600.

In the duplex copy mode wherein the sheet re-supply section 17 is employed, the sheets P subsequent to the fixing operation with the image formed on one side are guided downward along the right side of the switching member 601, and are stopped with the trailing edge thereof being sandwiched by the reversing roller 605.

Then the reversing roller 605 is reverse-rotated, and the sheets P are raised along a guide plate (not illustrated). These sheets P are conveyed to a plurality of rollers 701, 702 and 703, whereby the sheets P are reversed and conveyed.

The above description applies to the image forming process for the second surface of the sheets P. Further, any one of the aforementioned ejection paths is selected as the ejection path of the sheets P after having been fed out of the fixing apparatus T. In the meantime, the toner having been removed from the photoreceptor by the cleaning section 360 is fed to the waste toner box DT, wherein the toner is accommodated. It should be noted that the above description refers to the image forming apparatus for forming a color image. The above description is also applicable to the image forming apparatus for forming a monochromatic image.

What is claimed is:

1. A sheet supply apparatus comprising:

a sheet support tray on which a plurality of sheets are stacked and capable of moving in a vertical direction;

an upper limit detecting sensor for detecting a top surface position of the plurality of sheets stacked on the sheet support tray;

an adsorbent surface for attracting the sheets stacked on the sheet support tray from a top surface of the stacked sheets and adsorbing the topmost sheet of the stacked sheets;

a conveyance mechanism for conveying the sheet adsorbed on the adsorbent surface to a sheet conveyance path;

a separation air blasting mechanism having a separation air outlet wherein separation air is blasted from a sheet conveyance path side of the adsorbed sheet, and blasting the separation air to a leading edge of the sheet adsorbed on the adsorbent surface; and a control section for controlling the movement in a vertical direction of the sheet support tray according to an output of the upper limit detecting sensor so that a position of an upper surface of the stacked sheets on the support tray is adjusted to a height located below the separation air outlet, wherein adsorption is possible at the height located below the separation air outlet; and so that a fall region, in which a pressure difference with respect to a separation region is generated, is formed below the separation region in which the separation air blasted from the separation air outlet is blasted along the sheet adsorbed on the adsorbent surface, at least during a time from adsorption of sheets onto the adsorbent surface to a start of conveyance of the sheets by the conveyance mechanism when supplying a sheet;

wherein the following condition is satisfied:

$$1/10 \leqq H2/H1 \leqq 2/5$$

where H1 is a adsorbent height that represents a distance between the adsorbent surface and the top surface of the stacked sheets on the sheet support tray and H2 is a separation air blasting height that represents a height of the separation air outlet.

2. The sheet supply apparatus of claim 1, wherein the separation air blasted from the separation air outlet is blasted on the sheet having been adsorbed onto the adsorbent surface, approximately in the horizontal direction from a front of the adsorbed sheet.

3. The sheet supply apparatus of claim 1 further comprising a sheet raising air blast mechanism that blasts sheet raising air from a side of the sheets stacked on the sheet support tray, wherein the control section suspends the blasting of sheet raising air by the sheet raising air blast mechanism during a time from the adsorption of sheet on the adsorbent surface to the start of conveying the sheet adsorbed onto the adsorbent surface, and allows the separation air to be blasted by the separation air blasting mechanism.

4. The sheet supply apparatus of claim 1, wherein the separation air outlet is structured in such a way that, a separation air blasting height that represents a height of the separation air outlet is increased, as one goes toward both ends in the horizontal direction from a center of the separation air outlet.

5. The sheet supply apparatus of claim 1, wherein the separation air outlet has a horizontal length parallel to the adsorbent surface for ensuring that, when two or more sheets have been adsorbed onto the adsorbent surface, separation air for separating the second and later sheets can be blasted over a range for separation across the width of the sheet.

6. The sheet supply apparatus of claim 5, wherein an adsorbent height that represents a distance between the adsorbent surface and the top surface of the stacked sheets on the sheet support tray where adsorption is possible does not exceed 25 mm, and the horizontal length of the separation air outlet is equal to or greater than 60 mm.

7. A sheet supply unit comprising:

a single or a plurality of sheet trays for accommodating sheets each sheet tray comprises a sheet support tray on which a plurality of sheets are stacked and capable of moving in a vertical direction;

an upper limit detecting sensor for detecting a top surface position of the plurality of sheets stacked on the sheet support tray;

an adsorbent surface for attracting the sheets stacked on the sheet support tray from a top surface of the stacked sheets and adsorbing the topmost sheet of the stacked sheets;

a conveyance mechanism for conveying the sheet adsorbed on the adsorbent surface to a sheet conveyance path;

a separation air blasting mechanism having a separation air outlet wherein separation air is blasted from a sheet conveyance path side of the adsorbed sheet, and blasting the separation air to a leading edge of the sheet adsorbed on the adsorbent surface; and a control section for controlling the movement in a vertical direction of the sheet support tray according to an output of the upper limit detecting sensor so that a position of an upper surface of the stacked sheets on the support tray is adjusted to a height located below the separation air outlet, wherein adsorption is possible at the height located below the separation air outlet; and so that a fall region, in which a pressure difference with respect to a separation region is generated, is formed below the separation region in which the separation air blasted from the separation air outlet is blasted along the sheet adsorbed on the adsorbent surface, at least during a time from adsorption of sheets onto the adsorbent surface to a start of conveyance of the sheets by the conveyance mechanism when supplying a sheet;

wherein the following condition is satisfied:

$$1/10 \leqq H2/H1 \leqq 2/5$$

Where H1 is an adsorbent height that represents a distance between the adsorbent surface and the top surface of the stacked sheets on the sheet support tray and H2 is a separation air blasting height that represents a height of the separation air outlet.

8. An image forming apparatus comprising:

an image forming section for forming an image on a sheet;

a sheet supply apparatus for supplying a sheet to the image forming section; and a control section for providing control in such a way that sheets are supplied from the sheet supply apparatus to the image forming section and an image is formed by the image forming section;

wherein the sheet supply apparatus comprises:

a sheet support tray on which a plurality of sheets are stacked and capable of moving in a vertical direction;

an upper limit detecting sensor for detecting a top surface position of the plurality of sheets stacked on the sheet support tray;

an adsorbent surface for attracting the sheets stacked on the sheet support tray from a top surface of the stacked sheets and adsorbing the topmost sheet of the stacked sheets;

a conveyance mechanism for conveying the sheet adsorbed on the adsorbent surface to a sheet conveyance path; and a separation air blasting mechanism having a separation air outlet wherein separation air is blasted from a sheet conveyance path side of the adsorbed sheet, and blasting the separation air to a leading edge of the sheet adsorbed on the adsorbent surface;

wherein said control section controls the movement in a vertical direction of the sheet support tray according to an output of the upper limit detecting sensor so that a position of an upper surface of the stacked sheets on the support tray is adjusted to a height located below the separation air outlet, wherein adsorption is possible at the height located below the separation air outlet; and so that a fall region, in which a pressure difference with respect to a separation region is generated, is formed below the separation region in which the separation air blasted from the separation air outlet is blasted along the sheet adsorbed on the adsorbent surface, at least during a time from adsorption of sheets onto the adsorbent surface to a start of conveyance of the sheets by the conveyance mechanism when supplying a sheet, and wherein the following condition is satisfied:

$$1/10 \leqq H2/H1 \leqq 2/5$$

Where H1 is an adsorbent height that represents a distance between the adsorbent surface and the top surface of the stacked sheets on the sheet support tray and H2 is a separation air blasting height that represents a height of the separation air outlet.

* * * * *